United States Patent [19]

Ward

[11] Patent Number: 4,627,146

[45] Date of Patent: Dec. 9, 1986

[54] METHOD OF PRODUCING PIPE JOINTS

[75] Inventor: Gregg D. Ward, Olathe, Kans.

[73] Assignee: Energy Pipelines International Company, Kansas City, Mo.

[21] Appl. No.: 613,973

[22] Filed: May 25, 1984

[51] Int. Cl.[4] ..... B23P 25/00

[52] U.S. Cl. ..... 29/458; 29/525; 285/382.4; 285/382.1; 403/282

[58] Field of Search ..... 29/458, 525, 520, 523; 285/382, 382.2, 382.4, 382.5; 403/282

[56] References Cited

U.S. PATENT DOCUMENTS

| | | | |
|---|---|---|---|
| 1,296,016 | 3/1919 | Smith | 285/382.2 |
| 1,686,254 | 10/1928 | Rachlin . | |
| 1,889,795 | 12/1932 | Smith et al. | 285/382.5 X |
| 2,434,107 | 1/1948 | Folsom . | |
| 2,857,666 | 10/1958 | Beyer | 29/523 UX |
| 3,114,566 | 12/1963 | Coberly et al. . | |
| 3,208,136 | 9/1965 | Joslin . | |
| 3,210,102 | 10/1965 | Joslin . | |
| 3,343,252 | 9/1967 | Reesor . | |
| 3,466,738 | 9/1969 | Mount | 29/525 |
| 3,476,413 | 11/1969 | Coberly et al. . | |
| 3,494,640 | 2/1970 | Coberly et al. . | |
| 3,494,642 | 2/1970 | Coberly et al. . | |
| 3,556,567 | 1/1971 | O'Connor . | |
| 3,909,045 | 9/1975 | Meagher . | |
| 4,120,083 | 10/1978 | Echols | 29/458 |
| 4,152,818 | 5/1979 | Mort et al. | 285/382.4 X |
| 4,302,874 | 12/1981 | Colas | 29/458 X |
| 4,483,061 | 11/1984 | Trudell | 29/525 X |

FOREIGN PATENT DOCUMENTS

| | | | |
|---|---|---|---|
| 174521 | 4/1953 | Austria | 285/382.4 |
| 367419 | 2/1932 | United Kingdom | 29/523 |
| 435700 | 9/1935 | United Kingdom | 29/525 |

*Primary Examiner*—Charlie T. Moon

*Attorney, Agent, or Firm*—Litman, Day and McMahon

[57] ABSTRACT

Mechanical pipe joints and methods of forming same, wherein pipe ends are first prestrained into expanded bell and expanded pin shapes and then again strained by interference joining, both prestraining and subsequent straining being under controlled conditions which take maximum advantage of the metallurgical and physical properties of the materials to provide improved connection strength produced through approaching the ultimate strength of the material. Strain aging prior to joining may be used to further enhance connection strength to a point which requires exceeding the ultimate strength of the parent material.

6 Claims, 12 Drawing Figures

METHOD OF PRODUCING PIPE JOINTS

FIELD OF THE INVENTION

The present invention relates generally to methods of forming mechanical connections between lengths of metal tubing or pipe, and to the joints thereby created. More particularly, this invention involves connections produced by inserting the male or pin end of a pipe into the female, or bell end of an adjacent pipe. Such joints are commonly referred to as swaged tubing connections and are used in many industrial applications. For example, the pipeline industry occasionally uses swaged tubing connections for cross country transportation or transmission of corrosive and/or hazardous fluids at high pressures, including salt water, natural gas and crude oil; however, at least in this industry, it has not gained wide acceptance due to relatively low joint efficiencies:

DESCRIPTION OF THE PRIOR ART

There are several known methods for joining metal pipe by utilizing swaged bell and pin configurations, but it has been difficult to produce such connections at reasonable cost which consistently have the strength and reliability desired.

The strength of the joints created by many of the prior art swaging methods results from utilizing mechanical interference between the pipe ends, defined as the difference between the outside diameter of the pin and the inside diameter of the bell. A positive interference denotes a configuration where the outside diameter of the pin exceeds the inside diameter of the bell, creating stresses in the contacting parts when joined.

The earliest forms of swaged tubing joints were designed for zero or negative interference, and thus the ends were easily joined. Subsequent to joining, external pressure was applied, forcing the outer member, or bell, onto the inner member, or pin, causing a reduction in the nominal diameter of both parts and creating a mechanical locking and/or frictional interference.

Later types of prior art swaged tubing joints involved the insertion of a forming mandrel into one end of a pipe and expanding it to a bell having an inside diameter slightly less than the outside diameter of a non-expanded opposing pipe end, or pin. Since a configuration of this type has a positive interference, a press or hammering mechanism was employed to forcibly insert the pin into the bell. The resulting frictional forces resisted the longitudinal forces caused by external and/or internal loadings that urge separation of the joined parts.

The principal advantage of swaged joints is that the pipes or tubes may be joined faster and more economically than other known methods, such as threaded connections or welded junctions. The main disadvantage of prior art swaged joints is the tendency for them to leak and/or separate when subjected to high internal pressures and/or external forces.

Referring more specifically to prior art arrangements, U.S. Pat. No. 1,889,795 demonstrates that as early as 1928, joints were known which involved inserting the pin end of a pipe into an expanded or belled end of another pipe and decreasing the bell onto the pin by externally applying pressure.

U.S. Pat. Nos. 3,208,135 and 3,210,102 are the earliest joints known to applicant which utilized a positive interference as a means of associating the two pipes.

These patents disclose the formation of a groove to create a weak spot in the material, resulting in a controlled buckling action when the two parts are engaged. With pipes having a high diameter to wall thickness ratio, or with soft materials such as aluminum, the joint appears to form a connection capable of withstanding pressures commensurate with the strength of the materials. However, if used on high strength steel pipes or pipes with low to moderate diameter to wall thickness ratios, it becomes difficult to produce joining forces sufficiently high to create the buckling action necessary to seal the joint.

U.S. Pat. No. 3,466,738 involves flaring the end of the female member. The male member is then forcibly inserted into the flared end. When applied to soft materials exhibiting a high degree of ductility, this joint, fully engaged, is similar in appearance to other pin and bell configurations. However, for applications involving the use of high strength materials, the extreme interference inherent in this type of joint causes a radical increase in the forces necessary to produce insertion. Further, the resultant interfacial pressures are likely to produce galling, and the rapid expansion of the pipe during insertion tends to cause splits in the pipe body.

U.S. Pat. No. 3,476,413 discloses complementary tapered surfaces on interfitting parts to produce breakable (separable) strings, such as used for oil well drill pipe. Such pipe normally has a lower diameter-to-wall thickness ratio than that used for cross country gas or liquid transmission. The respective tapers are engaged along an extensive interface with high engagement pressure induced by tensile hoop stress in the bell and corresponding compressive stress in the pin. The induced engagement pressure, coupled with the effective coefficient of friction, acts to produce a high frictional resistance to relative displacement of the tapered surfaces. However, the taper interferes with creating optimum joint strength, since the effective tensile hoop stress and corresponding effective compressive stress necessarily vary, along with other complex load factors, as the engaging interface changes diameter along the axial length of the connection. One form, FIG. 3 of U.S. Pat. No. 3,476,413, shows a partially expanded pin end for the purpose of minimizing any restriction to fluid flow, but such partial expansion interferes with uniform and controlled work hardening.

Thus, all of the noted swaged engagements tend to produce relatively low joint efficiency which results in less than optimum connection strength. Joint efficiency is defined as the ratio of the strength of the connection to nominal yield strength of the pipe itself. The above discussed joining systems are sometimes capable of producing connections having a joint efficiency close to 1.0, but only under ideal conditions. However, commercial standard pipe manufacturing specifications commonly allow variations in physical dimensions and metallurgical properties that result in deleterious effects on the connection strength. Thus, in practice, the joint efficiency of such known joining systems are almost always less than 1.0 and commonly as low as 0.70 to 0.75. This has resulted in a slow acceptance thereof for many industrial uses, and particularly pipeline companies which deal with particularly critical cost factors, together with the rigors of high pressure transmission in an unfavorable service environment and severe consequences associated with a failure.

SUMMARY OF THE INVENTION

The present invention is directed to the formation of high integrity, high strength mechanical (friction retention) joints of the pin and bell type at relatively low cost. Such joints are particularly suitable for the joining of steel pipe manufactured to standard specifications permitting variations in physical dimensions and metallurgical properties which heretofore proved substantially deleterious to joint strength. Such deleterious effects are minimized in the practice of this invention by utilizing the controlled plastic expansion of both the pin and bell ends of the connection to produce a controlled "double expanded" construction. This creates a precise amount of positive interference which produces further desired changes in material properties, leading to consistently high strength and reliability of each connection.

The strength of the mechanical joint derives from the frictional forces developed between the two parts which result from the mechanical metal-to-metal interference. The magnitude of the frictional forces developed is dependent upon a combination of interfacial pressure, the insertion depth and the static coefficient of friction.

GENERAL CONSIDERATIONS

By way of explanation, it is well known that the force required to move, say one flat object in frictional contact with another flat object may be calculated by the equation $F_S=Nw$; where $F_S$ equals the force required to overcome the inertial and frictional forces resisting motion, N equals the force urging the two items together and w equals the static coefficient of friction. For tubular materials, specifically pin and bell mechanical joints, the definition of friction is modified to "$F_S=P_S(\pi DL)w$"; where $F_S$ equals the force required to separate the two pipes, $P_S$ equals the interfacial pressure, D equals the diameter of the interface, L equals the insertion depth, and w equals the static coefficient of friction. In other words, the force required to separate two pipes so joined is dependent upon the interfacial pressure, the diameter of the interface, the insertion depth and the coefficient of static friction. The relation of each of these variables to strength is given by the above noted equation. In application, each of the variables have both absolute and practical limitations.

The lower limit for insertion depth is determined by the connection strength desired. In general, the strength of the joint increases with the insertion depth. The upper limit for insertion depth is determined by properties of the material and the joining equipment. Assembling the connection generates a longitudinal compressive stress in the pin and bell. As the insertion depth is increased, the joining force also increases and, consequently, the longitudinal compressive stress on the pipe. High compressive stresses eventually will cause buckling of the pipe wall and destroy the interface. Therefore, the maximum value for L is determined by the critical buckling load. In practice, L is reduced from the theoretical maximum value to allow for a slight amount of misalignment between the pipe ends.

The limits of the interface diameter can be controlled through the noted double expansion, such control being important in the practice of this invention, as discussed below. The maximum interface diameter for conventional mechanical pin and bell configurations is determined by the normal manufactured dimensions of the two pipes being joined. The designer may choose the desired interface diameter, the only practical limitation being the ductility of the materials.

The coefficient of static friction is essentially a material property, but may be increased by surface treatments such as sandblasting or acidizing to remove surface contaminants. The strength of a mechanical interference connection is directly related to the static coefficient of friction. As w (the static coefficient of friction) is increased, the strength of the connection increases proportionately.

The joining force required to assemble the connection is dependent upon the dynamic coefficient of friction. It is a common practice in producing such friction type joints to use a lubricating medium during insertion. This lowers the dynamic coefficient of friction and consequently reduces the required joining force and bearing pressures.

The most significant factor that affects the joint strength is the interfacial pressure, $P_S$. From the above equation it can be seen that strength is directly proportional to the interfacial pressure. During the joining process, the interfacial pressure induces a hoop stress in both the bell and the pin, tensile in the bell and compressive in the pin. The resultant hoop stresses are synonymous with the interfacial pressure, hence the strength. Thus, the higher the induced hoop stresses, the stronger the connection.

Theoretically, the value of $P_S$ may vary from essentially zero up to and exceeding the pressure that would correspond to the ultimate strength of the materials. The construction of conventional mechanical connections is such that the normal value of $P_S$ is approximately equal to the yield pressure of the material or about 60 percent of the pressure that corresponds to ultimate strength.

In the elastic range, the interfacial pressure is related to the induced hoop stresses by Barlow's equation, $P_S=\gamma$ hoop $2t/D$, where $\gamma$ hoop equals the hoop stress, $P_S$ equals the interfacial pressure, D equals interface diameter and t equals wall thickness of the materials.

Although the above discussion is useful for describing the nature and behavior of such mechanical joining systems, in certain respects it is simplistic and does not adequately describe the interaction and interdependence of the variables. To develop these relationships, it is necessary to understand the effects of variations or changes in both the physical dimensions and the metallurgical properties of the materials.

By controlled said double expansion to predetermined physical dimensions, an interface may be formed which is sufficient to withstand all anticipated internal and external loadings while keeping the forming stresses less than an amount which would cause galling of the parts or splitting of the female member during joining.

Alternate embodiments of the invention, as well as the preferred form thereof, will be more fully understood by reference to the detailed description below.

BEHAVIOR OF THE MATERIALS

Figure 11:
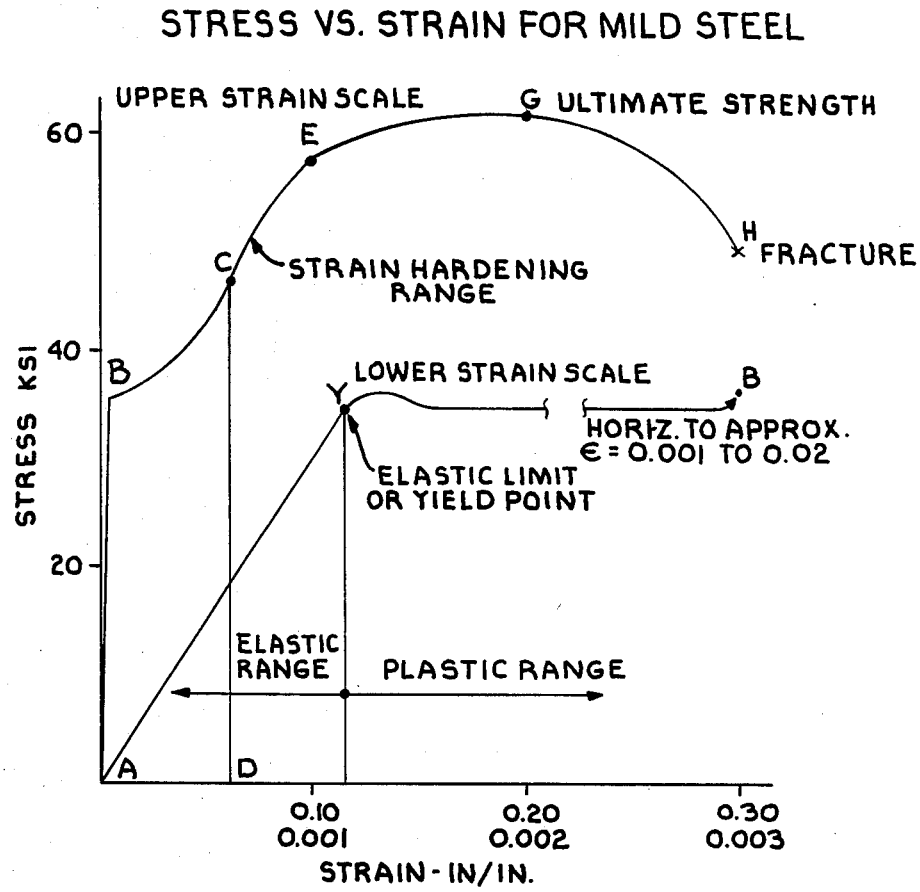
FIG. 11 illustrates a stress vs. strain curve for mild steel, the strain scale being shown over two ranges.

FIG. 11 shows a fairly typical stress vs. strain, or load vs. elongation curve for mild (low carbon) steel. As indicated by the upper branch ABCEGH of this curve, when steel is stressed to levels beyond the elastic limit B, the material undergoes a phenomena known as "strain hardening". This increase in the stress carrying ability at high levels of strain is evidence of a work induced change in the metallurgical properties of the material.

As previously noted, the strength of a friction type mechanical joint is dependent upon the induced level of stress in the material producing interfacial pressure. From FIG. 11, it is evident that the theoretical maximum value for joint strength would be achieved when the induced stress equals the ultimate strength G of the material.

The initial portion of the stress-strain curve for most materials is a straight line such as AB. In other words, the proportionality of load-to-deflection is a straight line, known as the elastic range. The ratio of stress to strain in the elastic range is a measure of the stiffness of the material and is commonly referred to as "Young's modulus" or the "modulus of elasticity". For normal stress and strain, Young's modulus E, is defined as $E = \text{stress/strain} = \gamma/\epsilon$. For steel, Young's modulus has a value of approximately $3.0 \times 10^6$KSI and is normally considered to be a constant.

In the elastic range, that is, up to the elastic limit, the induced strain or stretch is proportional to stress and fully recoverable upon removal of the load. In FIG. 11, lower branch AYB, the elastic limit, or yield point, is indicated by the abcissa of point Y. When a material is stressed to a point beyond the elastic limit, yielding occurs. At the yield point Y, there is an appreciable increase in strain with no appreciable increase in stress. Beyond the yield point, the behavior of the material is said to be plastic and the initial portion of the curve in the plastic range usually approximates a horizontal straight line, YB. In this zone, the material experiences "free" yield with the limitation that if straining is continued, the stress will again increase. The free plastic strain that occurs at the yield point with no appreciable increase in stress is 15 to 20 times the elastic strain at the proportional limit.

In the plastic range, a portion of the deformation remains after an applied load is removed. The permanent deformation or "set" is called the plastic deformation. The increase in the stress carrying ability of a material at high levels of strain, as noted above, is called strain hardening. Absolute control of the amount of strain hardening is a characterizing feature of this invention. Beyond the strain hardening region of the curve, the elongation of the material produces a significant reduction in the cross-sectional area, and consequently the load carrying ability thereof. At ultimate strength, the negative effects of the reduction in cross-sectional area begin to exceed the positive influence of strain hardening. Beyond ultimate strength, the load carrying ability of the material is reduced and the specimen will begin to neck, and finally fail by fracture.

Most structures are designed so that the stresses are less than the proportional limit and Young's modulus provides a simple and convenient relationship between the applied stresses and the resultant strain. Prior art pin and bell joining systems, during expansion of the bell, and subsequent joining of the parts, experience a degree of plastic deformation. However, the amount of expansion in prior art systems is, for the most part, determined by the "as manufactured" physical dimensions of the pin end and is generally not sufficient to induce an appreciable amount of strain hardening. For these prior art systems, the assumptions of elastic behavior and free plastic deformation beyond the yield point have proven normally sufficient for the analysis of joint strength and behavior.

The present invention differs in that it teaches positive control of the outside diameter of the pin, and consequently the interface diameter, allowing the degree of expansion or strain in the bell portion of the connection to be increased to the extent necessary for obtaining optimum effects of strain hardening. By controlled, predetermined expansion of both the pin and bell, it is possible to reach high levels of strain that correspond to ultimate strength of the material.

In the strain hardening range, there is no simple relationship between stress and strain. To obtain the optimum strength of the connection based upon metallurgical properties of the material in the plastic range, it is necessary to develop a relationship between the applied stress and the resultant strain that includes the effects of strain hardening. The method disclosed for obtaining the connection strength desired, is based upon analysis of metallurgical properties of the material and changes in those properties that result from the processes described.

The strength of a connection formed in accordance with this invention may be represented by the following: $F_S = K(\log_n {}^{A}O/A_1)^n 2tlc$ where $F_S$ equals force required to separate the two pipes, t equals nominal wall thickness of the materials, n equals the strain hardening exponent, in the range of 0.120–0.210 for steel (Properties of Metals in Materials Engineering, Low, ASM 1949), K equals strength coefficient in the range of 56,000–170,000 psi for steel, $A_0$ equals initial cross-sectional area, $A_1$ equals true cross-sectional area and C, in the range of 0.69–1.32 for steel, is a material constant calculated as the product of times w, the coefficient of static friction, determined experimentally to be in the range of 0.22–0.42 (Marks' Handbook for Mechanical Engineers, McGraw-Hill, Avallone, Baumeister, Avallone, 1978). The values n, K, and c reflect the absolute value, and the rate of change of, material properties as the induced level of stress is increased.

When the metallurgical composition, physical dimensions and manufacturing tolerances of the material are known, the last stated equation can be used to design a connection with strength approaching the ultimate strength of the materials. When applied to pipes or tubes manufactured to the specifications commonly used in the energy pipeline industry, the aforementioned conditions are satisfied, since although specifications allow variations in such properties, they are within a range that is easily tolerated and compensated for by plastic design of the components, rather than using the simplifying assumptions of modified elastic behavior.

FORMING THE JOINTS

Figure 4:
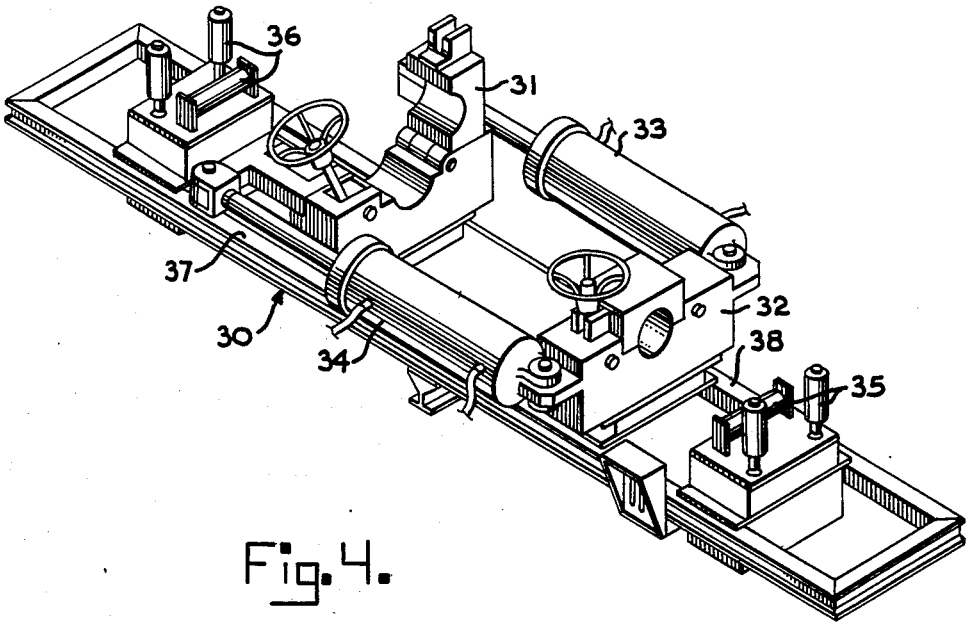
FIG. 4 is a partially schematic, perspective view showing one type of joining machine suitable for urging the expanded pipe ends together in the field.

Forming joints according to this invention requires tooling which normally includes a belling mandrel (FIGS. 7 and 10), a pinning mandrel (FIGS. 5 and 8), a pin swaging mandrel (FIGS. 6 and 9) and a hydraulic joining press (FIG. 4.)

Figure 2:
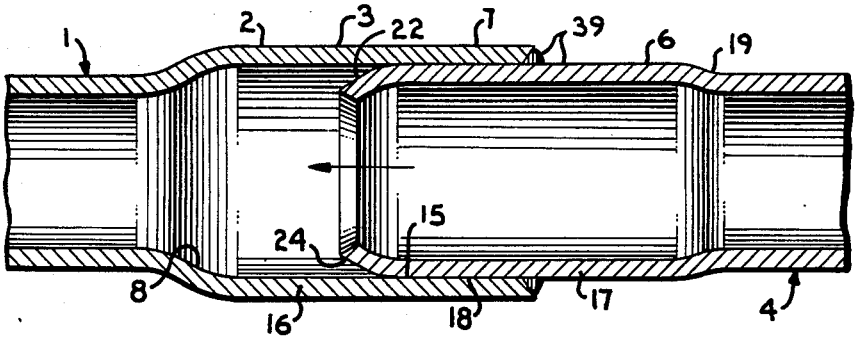
FIG. 2 is a view similar to FIG. 1, but showing the bell and pin ends during the joining process.

The stress vs. strain curve shown in FIG. 11 forms a guide for pipe end preparation and the joining process. The curve ABCEGH represents the stress vs. strain curve for a typical mild steel pipe material, and the curve ABCD corresponds to a typical load-unload, stress-strain, that occurs during the belling process. Curve DCE represents an idealized load-deformation curve for joining. ABC demonstrates how the expansion of the bell during bell end preparation (FIG. 10) causes a high tensile hoop stress in the material. As the belling mandrel is withdrawn, the induced hoop stress is reduced to zero. Since the material is strained beyond its elastic limit into the strain hardening range, a portion of the deformation AD remains after removal of the belling load and the yield strength of the material has been increased to C by strain hardening. Upon reloading, which occurs during the joining process (FIG. 2), further strain takes place (deformation not shown in FIG. 2) and the behavior of the pipe will follow curve DCE. Upon completion of the joining process (FIG. 3), the yield strength of the materials, and consequently the connection, has been increased from the original value Y to a subsequent value E, approximately equal to the ultimate strength G of the material.

Figure 12:
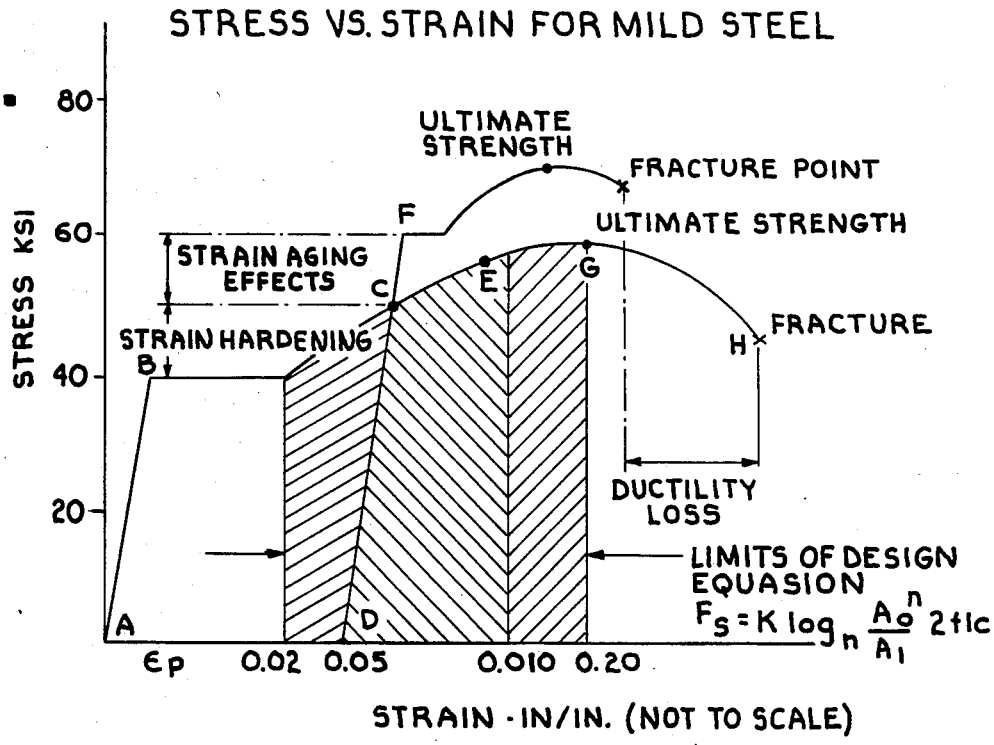
FIG. 12 illustrates a stress vs. strain curve for mild steel showing additional modification due to strain aging.

FIG. 12 demonstrates that strain aging of the material can be used to further enhance the strength of a connection. Curve CE in FIG. 12 is a portion of the load deformation and strain hardening curve produced by the joining process, as noted in connection with FIG. 11. CF in FIG. 12 shows the result of the strain hardening effect together with strain aging of the parts prior to joining. Qualitatively, the strain aging effect may be described as an increase in the yield strength of the material and a moderate loss of ductility.

The prerequisites for strain aging are, first, the material must be strained sufficiently to induce strain hardening and then it must be aged for a sufficient period of time to allow the effect to occur. The increase in yield that occurs due to strain hardening is virtually instantaneous and dependent upon the absolute amount of expansion during the belling and joining processes. Like strain hardening, the strain aging effect is the result of the expansion processes, however, the strain aging effect is both time and temperature dependent, being accelerated by higher temperatures.

It appears that an increase of 12–15 percent is possible when the prepared ends; that is, pin and bell, are aged for six weeks to three months, depending upon material properties and the ambient temperature during storage. The first prerequisite, plastic strain into the strain hardening range, is assured by controlled expansion of the materials during the end preparation processes. Such processes are easily accomplished at the pipe mill and storage or stockpiling prior to sale or use normally allows the strength increase due to strain aging.

By taking advantage of both strain hardening and strain aging phenomena, a mechanical joint may be constructed which exceeds the ultimate strength of the parent material.

DETAILED DESCRIPTION OF THE PREFERRED EMBODIMENTS

Figure 1:
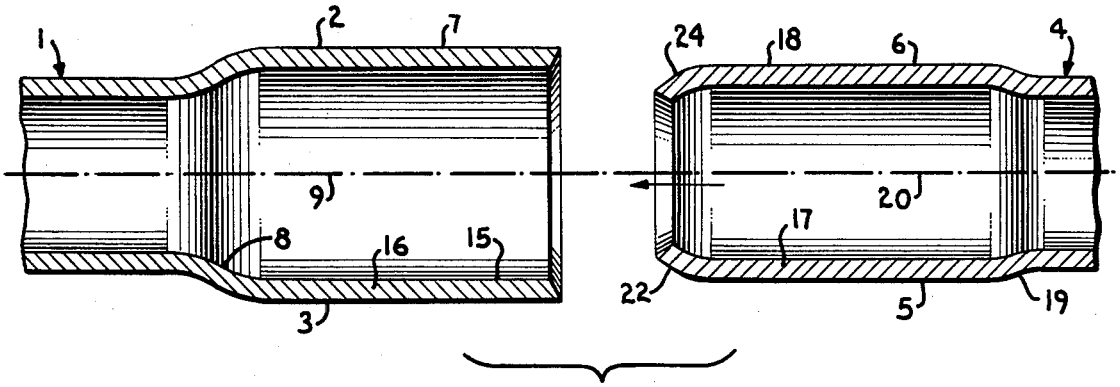
FIG. 1 is a fragmentary, cross-sectional, elevational view showing both the bell and pin ends of adjacent pipes expanded for joining in accordance with this invention.

Referring to FIG. 1, a section of a first pipe 1 is shown, having its end 2 formed into a bell 3. A section of a second pipe 4 is shown which is to be joined with the pipe 1. The pipe 4 has an end 5 formed into a lesser bell which is referred to as the pin 6. The bell 3 has a substantially cylindrical section 7 of considerable length, for example, about 1 ½ times the inside diameter, extending rearwardly along the longitudinal axis 9 of the pipe 1, followed by a shorter conical section 8 which tapers radially inwardly.

Figure 7:
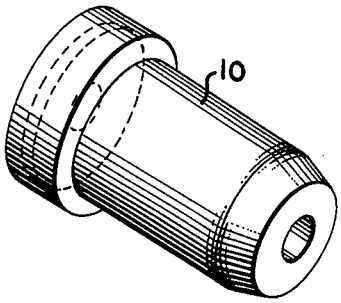
FIG. 7 is a partially schematic perspective view of a mandrel for expanding a pipe end into a bell.
Figure 10:
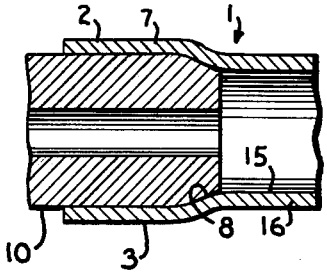
FIG. 10 is a fragmentary, cross-sectional view showing a pipe end expansion on the belling mandrel of FIG. 7.

The belling of the pipe 1 is suitably produced by urging the pipe end 2 over and along an appropriate mandrel 10 shown in FIGS. 7 and 10.

The bore 15 formed by the substantially cylindrical section of the bell 3 has a diameter slightly smaller than the outside diameter of the pin 6 so as to form an interference between the two pipe walls 16 and 17, when they are joined.

Figure 5:
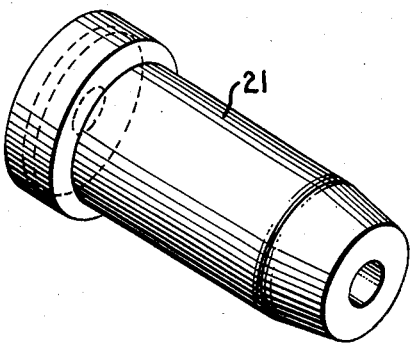
FIG. 5 is a partially schematic perspective view of a mandrel for expanding the pin end of a pipe.
Figure 6:
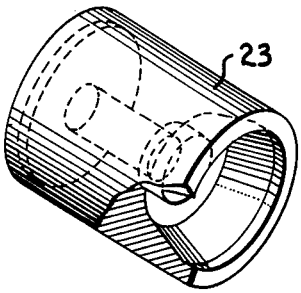
FIG. 6 is a partially schematic, fragmentary, perspective view, showing a swaging mandrel for producing a tapered front on the expanded pin end of a pipe.
Figure 8:
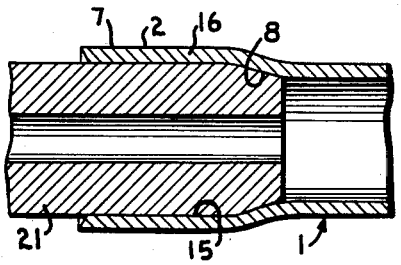
FIG. 8 is a fragmentary, cross-sectional view showing a pin end being expanded on the pinning mandrel of FIG. 5.
Figure 9:
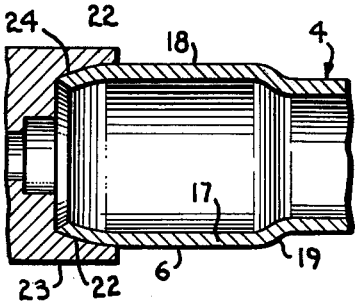
FIG. 9 is a fragmentary, cross-sectional view showing an expanded pin end being swaged to a tapered front on the swaging mandrel of FIG. 6.

The pin 6 has an expanded substantially cylindrical section 18 with a length generally equivalent to the mating length of the bell 3, followed by a conical section 19 which tapers toward the central axis 20 of the pipe 4. The pin 6 is formed by expansion over and along a mandrel 21 (FIGS. 5 and 8.) The leading portion of the pin 6 is swaged into a generally conical section 22 by means of an appropriate forming die 23 (FIGS. 6 and 9) prior to the pipe joining operation, forming a tapered and curving surface 24 which presents a smooth, rounded entry guide to reduce the tendency to gall as it encounters the bore 15. Further, the surface 24 of the pin and tapered surface 8 of the bell are substantially equal in length and declination and, when the bell and pin are fully engaged, produce an effective mechanical seal at 25, FIG. 3. The expansion of the pipe ends into the above noted pin and bell shapes is made cold.

Urging the pin 6 into the bell 3 is normally a field operation and requires a high force transmitting device such as apparatus 30 shown in FIG. 4. The apparatus 30 basically consists of heavy duty pipe clamps 31 and 32, which may be hydraulically or manually operated. The clamps 31 and 32 are movably spaced apart on a common center line, and joined by means of appropriate hydraulic cylinders 33 and 34. The respective pipe end sections (not shown in FIG. 4) rest upon suitable retaining and guide roller sets 35 and 36, and are secured in the respective clamps 31 and 32 just rearwardly of the respective conical sections 8 and 19.

Figure 3:
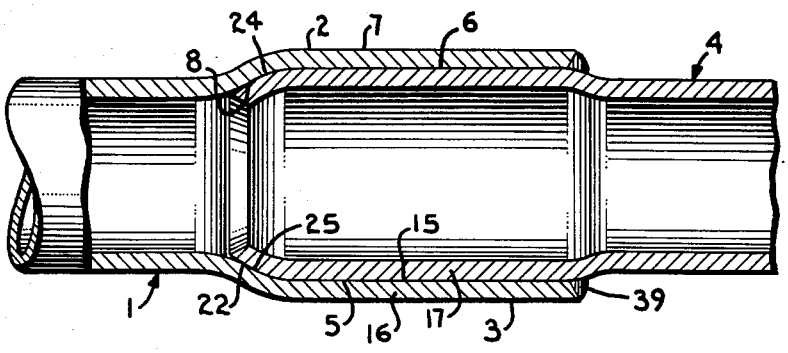
FIG. 3 is a further view similar to FIG. 1, but showing the connection completed.

Actuation of the hydraulic cylinders 33 and 34 causes the clamps 31 and 32 to move toward each other, guided by rails 37 and 38, whereupon the pin 6 is urged, under considerable force, into the bell 3 to the point where the tapered surfaces 24 and 8 solidly engage each other. A suitable epoxy lubricant 39, FIG. 3, is preferably applied to the outer surface of the pin 6 prior to entry for the dual purpose of reducing the tendency to gall and seal any leak producing passageways which may be created along the interface between the outer surfaces of the end 5 and the inner surface of the bore 15.

The practice of this invention is appropriate utilizing Schedule 10 through Schedule 100, API (American Petroleum Institute) pipe grades A25–X70, nominal diameters two inch and greater, seamless or ERW pipe. Most consistent performance is achieved when the physical dimensions and metallurgical properties of the pipes are constant, or vary minimally within stated limits. This is generally satisfied when pipe is selected that has been manufactured to standard specifications, such as AP1 5L, AP1 5LX, AP1 5LS, ASTM A53, ASTM A106, ASTM A134, ASTM A135, ASTM A139, ASTM A155, ASTM A211, ASTM A133, ASTM A381 and others with generally similar requirements.

By way of one specific example, utilizing 4.25 inch inside diameter pipes with 0.125 inch walls, the expansion of the bell may be 0.082 or 8.2%, the inside diameter of the pin 4.309 inches, inside diameter of the bell 4.560 inches, interference prior to joining 80 mils (0.080), depth of insertion excluding the mating conical sections (8 and 22) 6.250 inches and the length of tapered contact about 0.625 inches at 6 degrees.

Utilizing, for another specific example, 16.0 inch inside diameter pipes with 0.500 inch walls, the expansion of the bell may be 0.085 or 8.5%, inside diameter of the pin 15.275 inches, inside diameter of the bell 16,275 inches, interference prior to joining 100 mills (0.100), depth of insertion excluding the mating conical sections (8 and 22) 16 inches and the length of tapered contact about 0.750 inches at 5 degrees.

The optimum design range falls between strain limits of 0.05 to 0.10 inch per inch, and the optimum design point with strain aging is shown at F, FIG. 12, where F demonstrates higher strength than the ultimate strength G obtained without strain aging.

It should be understood that the nature and operation of this invention is not limited to the specific examples shown and is intended by the appended claims to cover all other such applications where the properties of the material makes it suitable for use. Thus, the foregoing disclosure and description is illustrative and explanatory only, and it is intended that various changes in the details may be made within the scope of the intended claims without departing from the spirit of the invention.

What I claim and desire to secure by Letters Patent is:

1. A method of forming pin and bell joints between the ends of tubular elements mode of metallic material subject to strain hardening, the method including the steps of:

(a) expanding the end of one element to form a substantially cylindrical pin;

(b) expanding the end of the other element a greater amount to form a substantially cylindrical bell with an inside diameter less than the outside diameter of said pin;

(c) the respective expansions being sufficient to strain the material of said tubular elements beyond the elastic limit thereof so as to induce strain hardening therein;

(d) the strain hardening in said bell being below the ultimate strength of the bell material;

(e) said differences in diameter being such that upon press-fit insertion of said pin into said bell, said bell is further strained beyond the elastic limit thereof to a point where the ultimate strength of the bell material is approached; and (f) press-fit inserting said pin into said bell.

2. The method as set forth in claim 1 wherein:

(a) the material of said tubular elements is mild steel.

3. The method as set forth in claim 1 wherein:

(a) a lubricant-sealant is applied between contacting pin and bell surfaces.

4. The method as set forth in claim 1 wherein:

(a) the yield strength of at least the bell material is increased by strain aging prior to said insertion.

5. The method as set forth in claim 1 including the step of:

(a) forming an inwardly directed section on the leading portion of said pin prior to said insertion.

6. A method of forming pin and bell joints between ends of first and second tubular elements made of metallic material subject to strain hardening, said method including the steps of:

(a) expanding said ends beyond the elastic limit of said material to form an expanded pin on an end of said first tubular element and an expanded bell on an end of said second tubular element; said expanding forming an interfering pin and bell of such conditions as to permit further deformation of at least one of said pin and bell further beyond the elastic limit thereof when said pin is press-fit inserted into said bell;

(b) said expanding straining the material sufficiently to produce strain hardening of the resultant pin and bell; and, (c) further straining beyond the elastic limit of said material at least one of said pin and bell;

(i) said further straining being produced by press-fit insertion of said pin into said bell thereby straining at least one of said pin and bell further beyond the elastic limit thereof to a point where the ultimate strength of the material of at least one of said pin and bell is approached.

* * * * *